US007766087B2

(12) United States Patent
Kotsonis et al.

(10) Patent No.: US 7,766,087 B2
(45) Date of Patent: Aug. 3, 2010

(54) METHODS AND APPARATUS FOR PLACEMENT OF WELL EQUIPMENT

(75) Inventors: Spyro Kotsonis, Le Plessis Robinson (FR); Eric Lavrut, Le Plessis Robinson (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 400 days.

(21) Appl. No.: 11/372,698

(22) Filed: Mar. 10, 2006

(65) Prior Publication Data

US 2006/0207770 A1 Sep. 21, 2006

(51) Int. Cl.
*E21B 31/107* (2006.01)

(52) U.S. Cl. ..... 166/381; 166/178; 175/293

(58) Field of Classification Search ..... 166/381, 166/178; 175/293, 95
See application file for complete search history.

(56) References Cited

U.S. PATENT DOCUMENTS

| | | | | |
|---|---|---|---|---|
| 3,785,193 | A * | 1/1974 | Kinley et al. | 72/393 |
| 4,071,086 | A | 1/1978 | Bennett | |
| 4,862,958 | A | 9/1989 | Pringle | |
| 5,156,223 | A * | 10/1992 | Hipp | 175/296 |
| 5,184,676 | A | 2/1993 | Graham et al. | |
| 5,495,902 | A | 3/1996 | Hailey et al. | |
| 5,782,311 | A | 7/1998 | Wentworth | |
| 6,431,270 | B1 * | 8/2002 | Angle | 166/66.5 |
| 6,695,065 | B2 * | 2/2004 | Simpson et al. | 166/384 |
| 6,725,932 | B2 * | 4/2004 | Taylor et al. | 166/301 |
| 7,104,732 | B2 * | 9/2006 | Mignacca | 405/235 |
| 7,347,282 | B2 * | 3/2008 | Betts et al. | 175/61 |
| 2002/0112866 | A1 * | 8/2002 | Buyers et al. | 173/91 |
| 2003/0102164 | A1 * | 6/2003 | Odell et al. | 175/57 |
| 2004/0154808 | A1 * | 8/2004 | Simpson et al. | 166/382 |

FOREIGN PATENT DOCUMENTS

| | | |
|---|---|---|
| DE | 10146024 | 4/2003 |

* cited by examiner

*Primary Examiner*—Shane Bomar
(74) *Attorney, Agent, or Firm*—Myron K. Stout

(57) ABSTRACT

A method and downhole tool are presented herein for driving completion equipment in a borehole. The method comprises the steps of positioning the completion equipment in the borehole; and moving the completion equipment along the borehole by operation of a downhole driving tool connected to the completion equipment. Operation of the driving tool comprises accumulating energy in the driving tool and releasing the energy to force a moveable member against an impact surface in the driving tool to provide a driving force which is applied to the completion equipment to move the completion equipment in the borehole, wherein the step of accumulating energy in the driving tool comprises providing energy to the driving tool by means of an energy source located at the surface selected from the group consisting of an electrical energy source provided by a wireline cable, a hydraulic energy source provided by a pipe, and combinations thereof.

17 Claims, 2 Drawing Sheets

METHODS AND APPARATUS FOR PLACEMENT OF WELL EQUIPMENT

CROSS REFERENCE TO RELATED APPLICATIONS

This application claims priority to European patent application 05290612.0 filed Mar. 17, 2005.

TECHNICAL FIELD

This invention relates to methods and apparatus for placement of equipment in underground wells such as oil, water or gas wells. The invention is particularly related to such placement in deviated wells that may have been drilled using non-rotary drilling techniques such as coiled tubing or wireline drilling.

BACKGROUND ART

In a conventional drilling operation, once the well has been drilled, it is completed by placing a liner or casing to support the well and provide zonal isolation. The casing is typically a steel pipe that is run into the well and located by placement of cement around the outside of the pipe to provide a seal between the pipe and the underground formation. Communication between the formation and the inside of the casing is achieved using explosive charges to perforate the casing at the desired locations. This technique is relatively straightforward where the well is vertical or close to vertical and has a relatively wide diameter. In this case, the casing can be run into the well under its own weight and there is usually sufficient clearance in the annulus for cement to be pumped down the casing and back up to the surface.

Where the well is highly deviated from vertical, especially when it is close to horizontal, placement of completion equipment can be more complex. In the deviated section, the effect of gravity in moving the equipment towards the bottom of the hole is greatly reduced (and is completely absent in a horizontal hole). Furthermore, drag due to contact between the casing and the borehole wall is greatly increased. If the deviated section is relatively short and/or it is preceded by a relatively long vertical section, the weight of casing in the vertical section is usually enough to force the part in the deviated section into position. However, there are times when placement in such a manner is not possible. In these cases, the end of the borehole is left open (sometimes called "barefoot completion"). In cases in which the formation is unstable or weak, this may cause problems due to hole collapse, wash out or sanding.

Recently, no-rig drilling techniques, such as coiled tubing drilling or wireline drilling have been proposed (as are discussed, for example WO 2004072437 A). Such techniques are often proposed for drilling highly deviated wells or sidetracks from existing wells. As well as the problems identified above for the placement of completion equipment in deviated wells, such techniques also suffer from the problem that there is no casing in the vertical section to force the completion equipment into the deviated well or sidetrack. This, combined with the high degree of deviation and small diameter common to such techniques mean that the drag is often too great to allow proper placement of completion equipment.

In conventional, rig-based drilling, one extreme form of drag is encountered when the drill pipe becomes stuck. Drillers often try to overcome this problem by the use of drilling jars placed in the drill string and operated to apply axial shocks in upwards and/or downwards directions to unstick the drill pipe. Drilling jars typically comprise a sliding mandrel in a sleeve. In use, the mandrel is driven up or down by some form of stored energy, a hammer on the mandrel striking an anvil on the sleeve so as to impart a shock and (it is hoped) free the stuck pipe. The use of drilling jars is discussed in more detail in ASKEW. Jars, Jarring and Jar Placement. *Oilfield Review*. Oct. 1991, p. 52-61. One common form of drilling jar is a hydraulic jar. A hydraulic jar consists of two reservoirs of hydraulic fluid separated by a valve. When tension or compression is applied to the tool in a cocked position, fluid from one chamber is compressed and passes through the valve at high flow resistance into the second chamber. This allows the tool to extend or contract. When the stroke reaches a certain point, the compressed fluid is allowed to suddenly bypass the valve. The jar trips as the fluid rushes into the second chamber, instantly equalising pressure between the two chambers and allowing the hammer to strike the anvil. The greater the force on the jar, the sooner and more forceful the release. Examples of commonly-used drilling jars are the PowerTrac jar and the Earthquaker and Hydraquaker jars.

Such techniques are not typically applicable do to the absence of the drill string to apply a force to cock and trip the jar, such as, for example, in the context of drilling with a wireline machine.

DISCLOSURE OF THE INVENTION

A first aspect of the invention comprises a method of moving equipment along a borehole, comprising:

positioning the equipment in the borehole; and moving the equipment along the borehole by operation of a downhole driving tool connected to the equipment, operation of the driving tool comprising accumulating energy in the driving tool and releasing the energy to force a moveable member against an impact surface in the tool to provide a driving force which is applied to the equipment to move it along the borehole.

Preferably the steps of accumulating energy and releasing it to provide the driving force are repeated to move the equipment in a series of steps.

In one embodiment, the driving tool is also able to provide a moving force directly on the equipment. In another embodiment, the force is applied via an intermediate member.

A second aspect of the invention comprises a downhole tool for moving equipment along a borehole, comprising a tool body having a first impact surface;

a moveable member having a second impact surface, mounted on the tool body and moveable between a first position distant from the first impact surface and a second position with the impact surfaces in contact; and a release mechanism for releasing the moveable member such that the energy in the accumulator creates a force on the moveable member and drives it from the first position to the second position;

characterised in that the downhole tool further comprises:

an energy accumulator connected to the moveable member; and a system for energising the accumulator.

By providing the energy accumulator and energising system in the downhole tool, it is possible to use a hydraulic or electric power supply to energise the accumulator and provide the driving force to the moveable member. This avoids the need for the drill string to provide the drive to move the equipment along the well.

The moveable member can be a piston hammer sliding in a bore in the tool body. The impact surface can be constituted by an anvil mounted at the end of the bore.

In one embodiment, the bore is filled with a hydraulic fluid. In such a case, a restricted diameter section can be provided in the bore which prevents easy flow of fluid from one side of the piston to the other, the release mechanism comprising a throttle or flow restriction that allows fluid to pass from one side of the piston to the other such that the piston moves out of the restricted diameter section.

The energy accumulator can comprise a spring. In one embodiment, energy is stored in a compression spring connected to the moveable body on the opposite side to the impact surface. The spring can be compressed using the energising system.

The energising system can comprise a tractor or crawler device which locks in the borehole and extends to compress the spring. Other energising systems such as hydraulic pumps or mechanical systems such as ground ball or planetary screws can be used. The energy source can be electrical, provided by a cable from the surface, hydraulic, provided by a pipe from the surface, or combinations of both. Electrical is particularly preferred.

MODE(S) FOR CARRYING OUT THE INVENTION

Figure 1:
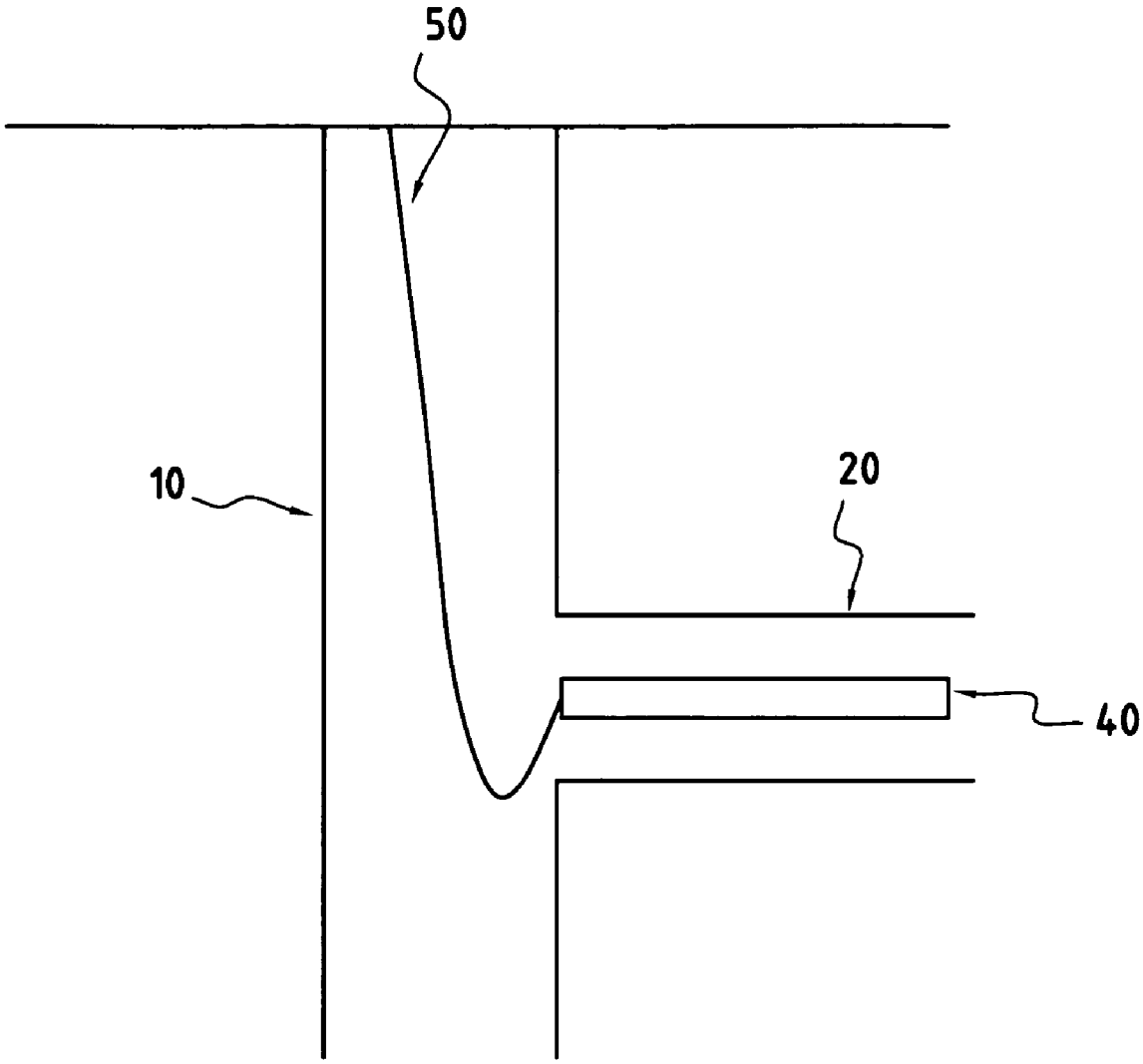
FIG. 1 shows a schematic view of an embodiment of the invention in a horizontal side branch borehole.

FIG. 1 shows a drilling system according to an embodiment of the invention in a borehole such as an oil or gas well. The borehole comprises a main section 10 which is generally vertical and a side branch 20 that extends away from the main section. The side branch 20 is horizontal or close to horizontal. The embodiment of the system according to the invention comprises a downhole tool 40, including an element of downhole equipment (not shown separately) to be installed in the side branch 20, which is suspended on a wireline cable 50 extending from the surface. The wireline cable 50 provides power and data communication with the downhole section 40 and can be used to raise or lower the downhole section 40 in the vertical main part of the borehole 10.

The side branch may typically have been drilled using a system such as is described in WO 2004072437 A or EP 04292251. In both of these cases, a tractor is used to advance a drilling assembly and other equipment along the side branch.

Once drilled, the wellbore must be stabilized to avoid events such as cave-ins, washouts, and sand plugging, amongst others. In conventional and coil-tubing (CT) drilling, this is done by pushing a metallic liner through the open hole and, optionally, cementing around it (to impede gas or water migration.) The liner runs partway to depth on its own weight, but once this weight is insufficient, the drillstring or coil tubing is used to push it the rest of the way. However, in wireline drilling operations, this is not possible.

The forces required to force such a liner into the horizontal section can be in the 30-60,000 lbs range (for a 1 km long 2⅜" liner in a horizontal lateral), and even more in the case of bigger liners or shorter radius. It is very difficult to apply this force using a tractor (of the type mentioned above.) Part of the difficulty is the force itself, tractors typically not generating such forces. However, a further problem is anchoring the tractor in the well in possibly corroded tubing or casing with a force three or more times the axial force required (anchoring with 3×30,000 lbs, or 90,000 lbs would create enough friction to push axially with 30,000 lbs). Additional considerations include the completion equipment (such as sub-surface valves, gas-lift valves, etc) already in the well that the tractor would need to avoid when anchoring (to avoid damaging it).

Figure 2:
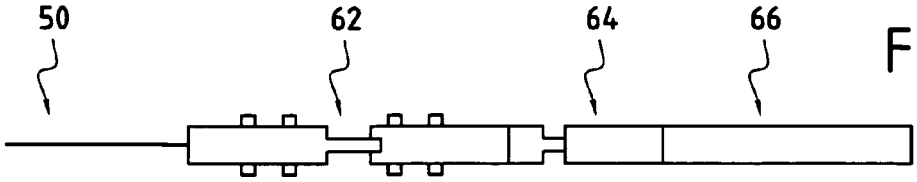
FIG. 2 shows a schematic view of a first embodiment of the invention.

One embodiment of the present invention uses the force available from a wireline tractor (typically a few thousand pounds) to detonate a 'jarring' force downwards on the liner. FIG. 2 shows a bottom hole assembly (BHA) of such a system, comprising a wireline cable 50 extending from the surface down to a tractor 62. The tractor 62 uses its stroke to cock and deploy the driver tool 64 that is arranged to create more than a 10-fold axial impact on the equipment to be installed in the well, in this case a liner 66, thus forcing it further downhole.

Figure 3:
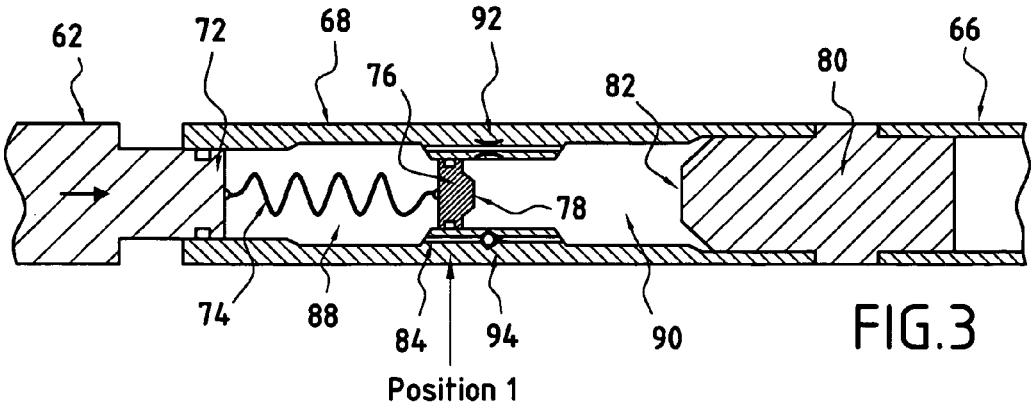
FIG. 3 shows detail of the embodiment of FIG. 2.
Figure 4:
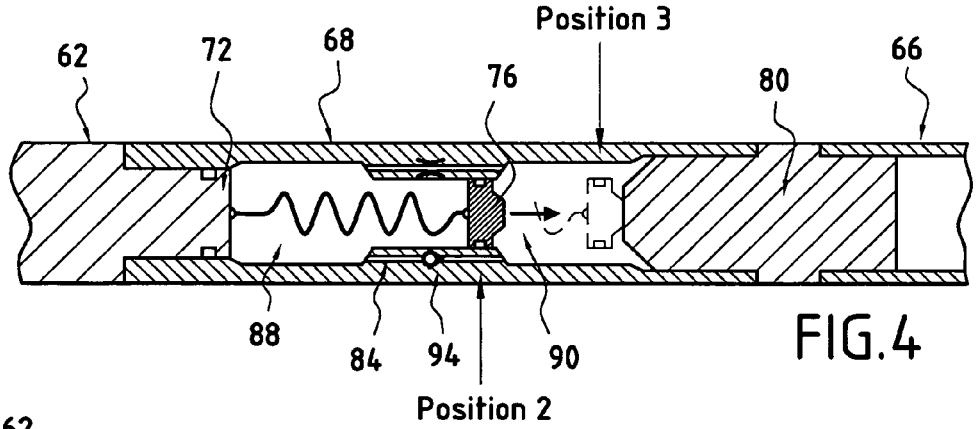
FIG. 4 shows the embodiment of FIG. 2 at a later stage of operation.

FIG. 3, shows one embodiment of the driver tool 64 in the cocked position, before the stroking has initiated. The tool 64 comprises a tool body 68 defining a central bore 70 filled with oil or other hydraulic fluid. The tractor 62 connects to one end via a mandrel 72 to apply force to a spring 74 received in the bore 70. A piston hammer 76 is connected to the far end of the spring 74 so as to be slidable in the bore 70. An impact surface 78 is provided on the hammer 76 opposite to the connection to the spring 74. The opposite end of the bore 70 to the mandrel end 72 is closed by an anvil 80 with its own impact surface 82 facing the piston hammer 76. A region of restricted diameter 84 is provided part way along the bore 70 and the piston hammer 76 engages in this region with seals 86 so as to effectively form two chambers 88, 90, one on either side of the piston hammer 76. A small vent or throttle 92 is provided to bypass the region 84 and provide fluid communication between the chambers 88, 90.

As the tractor 62 starts pushing, the spring 74 is compressed (storing potential energy) against the resistance provided by the liner 66 in the borehole. The piston 76 is pushed downward by the spring 74 but cannot move at the same velocity as the tractor is pushing the upper mandrel 72 because of the relatively incompressible oil in the lower chamber 90 being unable to pass into the upper chamber 88 other than through the throttle 92. Consequently, at the time that the mandrel 72 reaches a fully closed position, the piston 76 is close to the end of the restricted region 84 (position 2). At this time the pressure differential between the upper and lower oil chambers 88, 90 is considerable.

Oil passing through the throttle 92 allows the piston 76 to continue to move out of the restricted region 84 at which time oil can freely pass from the lower chamber 90 to the upper chamber 88 around the piston 76 and through the bore 70. At this point, the piston 76 is free and acted upon by the compressed spring 74. The spring 74 accelerates the piston 76 to its lower position (Position 3) where it impacts the anvil 80. The sudden deceleration during impact is a net force transmitted to the anvil 80 and on to the liner 66, forcing it further downhole and into position.

To re-cock the tool, the piston 76 is pulled back to position 1 by the action of the tractor 62 via the spring 74. A one-way check valve 94 can be provided to allow oil to flow easily from the upper chamber to the lower chamber so that there is less resistance to movement of the piston when moving to the top of the restricted region 84.

In use the firing and re-cocking procedures described above are repeated, the equipment (liner 66) moving along the borehole in a series of steps until it reaches the desired position.

Figure 5:
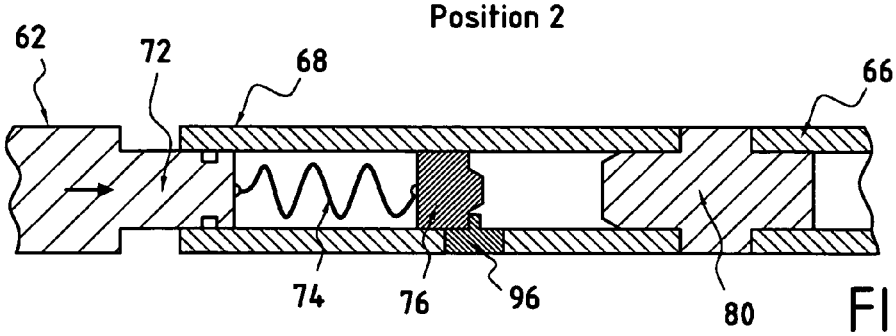
FIG. 5 shows a further embodiment of the invention.

In the example described above, the unlocking or firing mechanism is provided by the metered flow of oil through the throttle 92. An alternative mechanism can use a physical trigger 96 (FIG. 5). This can be any type of mechanical, hydraulic, or electrical trigger (or combination thereof).

Figure 6:
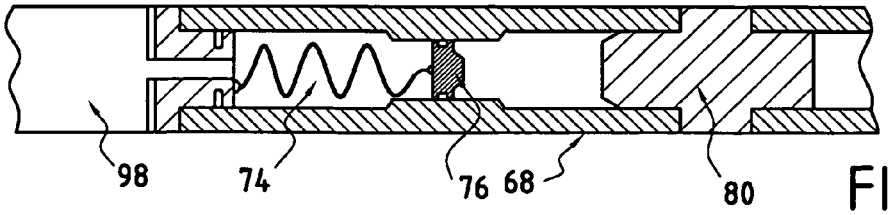
FIG. 6 shows another embodiment of the invention.

The normal drive action of the tractor 62 is used to compress the spring in the example described above. The tractor anchors in the borehole and pushes against the resistance provided by the equipment to compress the spring. In an alternative embodiment (FIG. 6) the stroke used to compress the spring is obtained with a hydraulic system (a hydraulic piston for example), or a mechanical system (such as a ground ball or planetary roller screw) 98. This does not necessitate the use of a tractor for the activation. However, as a tractor is often present, it can provide an anchor for the activation system. If no tractor is present, an anchor of some sort is required to provide the reaction for compressing the spring.

Various changes are possible within the scope of the invention. The spring can be replaced by some other energy storage means, such as a compressed fluid. Also, the operation is not limited to the positioning of liners, but can be used for other sorts of downhole equipment. The same operation can also be used to open or close downhole valves or windows so avoiding the use of expensive and unreliable electrical valves.

A tool according to the present invention can also be inverted in the tool-string and apply the force upwards to unstick tools that have become lodged or have suffered a failure below it. The combination of an up- and down-stroke impact can lead to a longer tool, but one that is capable of performing a wider range of operations downhole. Due to the high level of impact imparted by the present invention a spring and dashpot buffer between the activation means (tractor, anchor) and the present invention may need to be included to ensure the upwards force is transmitted to the components below the invention and not to its activation means (with the risk of damaging the anchoring means). This buffer could be a hydraulic cylinder with a one-way bypass capable of transmitting the axial activation force from the tractor, but slipping when the tool impacts.

The invention claimed is:

1. A method of driving completion equipment in a borehole, comprising the steps of:

positioning the completion equipment in the borehole, the completion equipment comprising a liner; and moving the completion equipment along the borehole by operation of a downhole driving tool connected to the liner via an anvil extending from an end of the downhole driving tool, operation of the driving tool comprising accumulating energy in the driving tool and releasing the energy to force a moveable member against an impact surface of the anvil to provide a driving force which is applied downward on the completion equipment to move the completion equipment in the borehole;

wherein the step of accumulating energy in the driving tool comprises providing energy to the driving tool by means of an energy source located at the surface selected from the group consisting of an electrical energy source provided by a wireline cable, a hydraulic energy source provided by a pipe, and combinations thereof.

2. The method as claimed in claim 1, wherein the steps of accumulating energy and releasing the energy to provide the driving force are repeated to move the completion equipment in a series of steps.

3. The method as claimed in claim 1 wherein the driving tool provides a moving force directly on the completion equipment or via an intermediate member.

4. The method as claimed in claim 1 wherein two driving tools are provided arranged each to drive the tool in a opposite directions, the method comprising moving the completion equipment either up or down the borehole by operation of the appropriate driving tool.

5. The method as claimed in claim 1, wherein the completion equipment is selected from the group consisting of liner, casing, coiled tubing, and combinations thereof.

6. A downhole tool for driving completion equipment in a borehole, comprising a tool body having a first impact surface constituted by an anvil extending from the tool body, the completion equipment comprising a liner connected to the anvil;

a moveable member having a second impact surface mounted on the tool body and moveable between a first position distant from the first impact surface and a second position with the impact surfaces in contact;

an energy accumulator connected to the moveable member; and a system for energizing the accumulator comprising an energy source located at the surface selected from the group consisting of an electrical energy source provided by a wireline cable, a hydraulic energy source provided by a pipe, and combinations thereof; and a release mechanism for releasing the moveable member such that the energy in the accumulator creates a force on the moveable member and drives the moveable member from the first position to the second position, thereby providing a driving force which is applied downward on the completion equipment to move the completion equipment in the borehole.

7. The tool as claimed in claim 6, further comprising a hydraulic or electric power supply to energize the accumulator and provide the driving force to the moveable member.

8. The tool as claimed in claim 6, wherein the moveable member is a piston hammer sliding in a bore in the tool body.

9. The tool as claimed in claim 8, wherein the anvil is mounted at an end of the bore.

10. The tool as claimed in claim 8, wherein the bore is filled with a hydraulic fluid.

11. The tool as claimed in claim 10, wherein a restricted diameter section is provided in the bore to prevent easy flow of fluid from one side of the hammer piston to the other, the release mechanism comprising a throttle or flow restriction that allows fluid to pass from one side of the hammer piston to the other such that the hammer piston moves out of the restricted diameter section.

12. The tool as claimed in claim 6, wherein the energy accumulator comprises a spring.

13. The tool as claimed in claim 12, wherein energy is stored in a compression spring connected to the moveable body on an opposite side to the impact surface.

14. The tool as claimed in claim 12, wherein the spring is compressed using the system for energizing the accumulator.

15. The tool as claimed in claim 12, wherein the system for energizing the accumulator comprises a tractor or crawler device, a hydraulic pump, ground ball or planetary screws, or combinations thereof.

16. The tool as claimed in claim 6, comprising two members arranged so that one moves the completion equipment in a first direction and the other moves the completion equipment in an opposite direction.

17. The tool as claimed in claim 6, wherein the completion equipment is selected from the group consisting of liner, casing, coiled tubing, and combinations thereof.

* * * * *